United States Patent [19]

Johnson

[11] 4,200,325

[45] * Apr. 29, 1980

[54] SYNTHETIC ORGANIC POLYMERIC PLASTIC SLING PROTECTED BY VULCANIZED OR CURED ELASTOMERIC LAMINATE AT LOAD CONTACTING AREA THEREOF

[75] Inventor: Charles E. Johnson, Kenmore, N.Y.

[73] Assignee: Buffalo Weaving and Belting Co., Buffalo, N.Y.

[ * ] Notice: The portion of the term of this patent subsequent to Oct. 4, 1994, has been disclaimed.

[21] Appl. No.: 835,866

[22] Filed: Sep. 23, 1977

Related U.S. Application Data

[63] Continuation-in-part of Ser. No. 628,958, Nov. 5, 1975, Pat. No. 4,052,095.

[51] Int. Cl.[2] ..... B66C 1/12

[52] U.S. Cl. ..... 294/74

[58] Field of Search ..... 294/74, 75, 76, 77, 294/67 E, 67 EA; 428/196, 195, 272; 182/137, 138

[56] References Cited

U.S. PATENT DOCUMENTS

| | | | |
|---|---|---|---|
| 2,561,215 | 7/1951 | Mighton | 428/272 |
| 2,972,799 | 2/1961 | Kern et al. | 428/195 |
| 3,290,083 | 12/1966 | Norton | 294/74 |
| 3,776,585 | 12/1973 | Bridgehouse | 294/74 |
| 4,052,095 | 10/1977 | Johnson | 294/74 |

FOREIGN PATENT DOCUMENTS

| | | | |
|---|---|---|---|
| 798197 | 11/1968 | Canada | 294/74 |
| 1202841 | 8/1970 | United Kingdom | 294/74 |

*Primary Examiner*—James B. Marbert

*Attorney, Agent, or Firm*—Bean, Kauffman & Bean

[57] ABSTRACT

A web sling, such as one of the endless, standard eye-and-eye or twisted eye type, is made from a web of woven synthetic organic polymeric plastic strands, such as those made from nylon, aramid or polyethylene terephthalate filaments, with a lamina of elastomeric material, such as polyurethane, vulcanized or cured onto a load contacting area thereof. The elastomeric material penetrates surface openings between the polymeric plastic strands but may be prevented from penetrating through the web, when so desired. To assist the elastomer in holding tightly to the strands there is applied to the web before vulcanizing a thin coating of a curable adhesive material, such as resorcinol-formaldehyde. In preferred embodiments of the invention particular thicknesses of filaments, strands, webs, adhesive coatings and elastomeric coverings are employed, the sides of the web are also integrally covered with the elastomer in the areas thereof designed to contact a load to be lifted or carried and the areas thereof designed to contact the lifting member are also so covered. Also within the invention are methods of manufacturing the described webs and slings.

The slings of this invention are longer lasting than conventional nylon, aramid or polyester fiber slings because the elastomeric covering physically separates the fibers of the web from contact with loads carried by the slings and protects the web against abrasion and cutting by the load, helps to reduce any shocking forces applied to the web by shifting of loads or jerking of the sling by lifting mechanisms and better secures the load in position in the sling. Similarly, when the lift contacting portions of the sling are covered with vulcanized elastomer they also last longer, primarily due to the elastomeric covering protecting against abrasion and cutting of the polymer filaments and strands by the lifting hook or other lifting member.

27 Claims, 6 Drawing Figures

SYNTHETIC ORGANIC POLYMERIC PLASTIC SLING PROTECTED BY VULCANIZED OR CURED ELASTOMERIC LAMINATE AT LOAD CONTACTING AREA THEREOF

This application is a continuation-in-part of my application Ser. No. 628,958, filed Nov. 5, 1975, which issued as U.S. Pat. No. 4,052,095 on Oct. 4, 1977.

This invention relates to slings, especially those of the flat web or strap type, normally employed for hoisting or lowering cargo before or after transportation or storage thereof. More particularly, it relates to slings made of webs of synthetic organic polymeric plastic fibrous materials which have been protected at load contacting portions thereof so as to resist cutting and abrasion and thereby to provide longer sling life.

Slings made of synthetic organic polymers have been employed commercially in hoisting various types of cargoes and other materials. Such slings can, to a large extent, replace woven wire and cable slings because they are more economical, do not scratch polished surfaces of materials being hoisted and do not contain jagged edges of metal which may cut workers' hands. Additionally, such slings are normally resistant to water, unlike steel slings, which may rust, and if they are correctly chosen with respect to the material of construction, may be resistant to particular corrosive media.

Although slings made from nylon and polyesters are competitive with metal slings they are susceptible to abrasion and cutting by rough surfaced or sharp edged loads and the slight shiftings of the loads during movement may be enough, repeated many times, to cause separations of some filaments or strands of the sling, which may weaken it and may cause it to require replacement before the end of its expected useful life. To avoid this pads, mats, protective edges and corners, etc., have been employed to cover such sharp and rough edges of the cargo but this requires additional handling, time and expense and sometimes the protective devices may be accidentally removed during hoisting or may be damaged or lost, resulting in wear on the sling. Sleeves of webbing of double or triple thicknesses may be used but the sleeves can be unintentionally moved from desired location to less functional position and they also can be worn through by the movements of the loads and contacts with sharp edges thereof.

The present invention provides a novel sling construction which results in the portions of the sling expected to be load contacting during use being covered with a protective elastomeric material tightly bound to the sling web of synthetic organic polymeric plastic material and thick enough to prevent rough or sharp surfaces of cargo or other hoisted materials from penetrating it and cutting filaments or strands of the web. Although various other advantages of the invention will be described the main significance of the elastomer-protected polymeric web sling of this invention is in increasing the useful life of such slings, often by more than 100%, as from six months to two years or longer.

In accordance with the present invention a sling, preferably a flat web or strap sling, comprises a web of woven synthetic organic polymeric strands, with a lamina of suitable elastomeric material vulcanized or cured onto a load contacting surface thereof, such elastomeric laminate filling surface openings between the polymeric plastic strands and when desired, not penetrating the thickness of the web. Also within the invention are modifications of the sling described and methods for the manufacture thereof.

The present invention will be readily understood by reference to the description herein of various preferred embodiments thereof, together with the drawing, in which.

Figure 1:
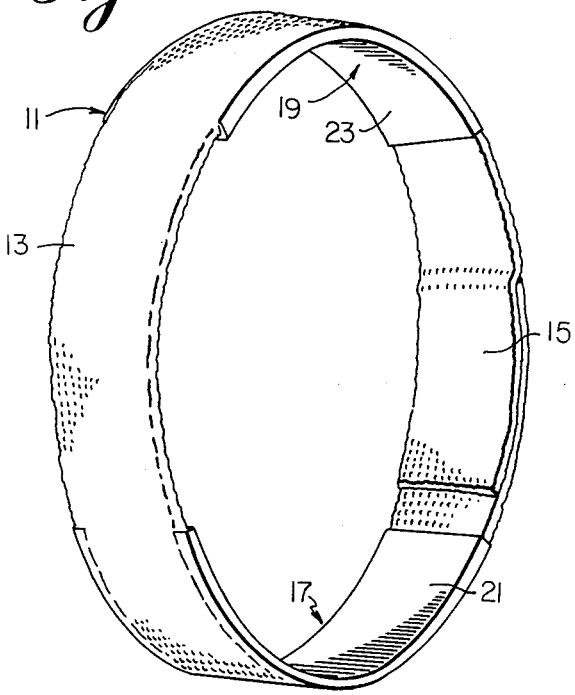
FIG. 1 is a perspective view of an endless strap or flat sling of the present invention showing vulcanized elastomeric protective coverings on both load contacting and lift contacting portions thereof.
Figure 2:
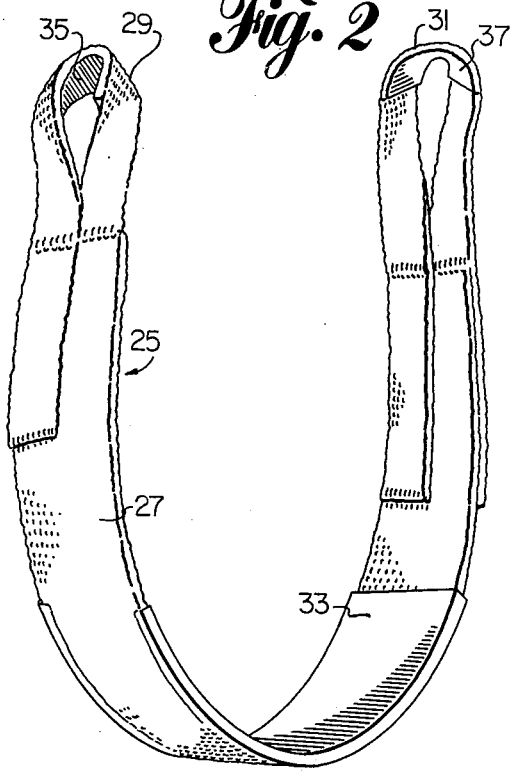
FIG. 2 is a perspective view of a twisted eye sling with protective coverings at load contacting and lift contacting portions.
Figure 3:
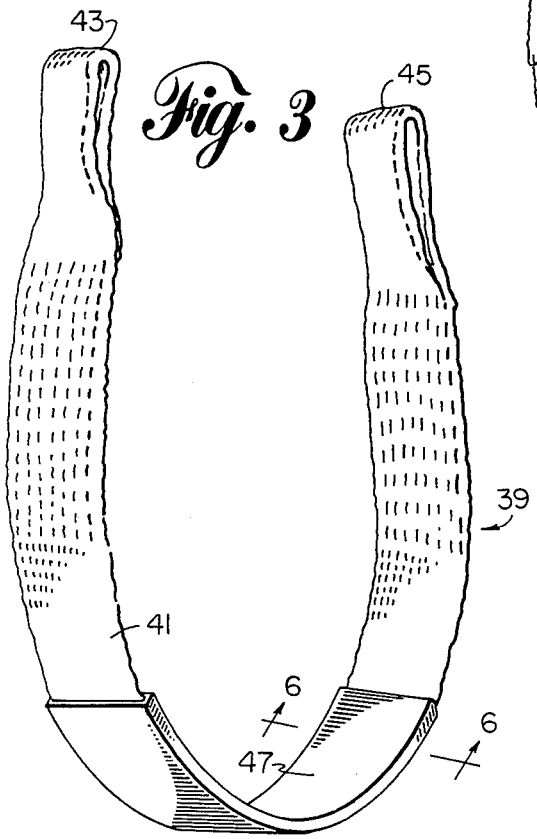
FIG. 3 is a standard eye-and-eye sling with protective elastomeric covering at a load contacting portion thereof, which also extends below the load contacting surface and covers another major face of the web, shown in perspective.

Endless sling 11, illustrated in FIG. 1, is of a web 13 of woven synthetic organic polymeric strands, each of which is composed of polymeric filaments. The web is sewn onto itself at 15, preferably without twisting thereof. Load bearing or load contacting elastomeric protective covering portion 17 and lift, hook or hardware contacting portion 19 of the sling are shown covered by protective elastomeric coverings or laminae 21 and 23, respectively. In FIG. 2 sling 25 includes a web portion 27, two twisted eyes 29 and 31 and protective elastomeric coverings 33, 35 and 37, with the first of these being for the load contacting portion of the web and the others being for the lift contacting portions of the eyes. In FIG. 3 standard eye-and-eye sling 39 includes a web portion 41 and standard eye portions 43 and 45, with the load contacting part of the web being protected by elastomeric covering 47 which covers the entire web at that location.

Figure 4:
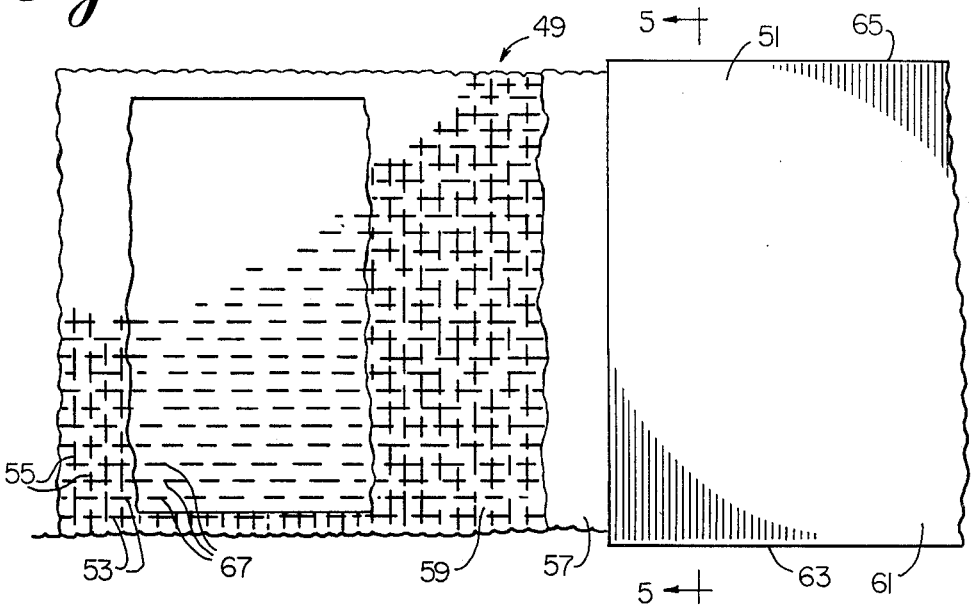
FIG. 4 is a partially cut away top plan view of a portion of a sling of this invention, showing protective elastomeric covering and adhesive coating thereon.

FIG. 4 shows a portion of a polymeric web 49 having an elastomeric protective covering 51 vulcanized to it. Warp yarns 53 and woof yarns 55 of the web are illustrated, as are straight longitudinal yarns 67, also included in the present webs for their good load bearing capacities (they are not weakened by bendings). Adjacent to the covering of protective elastomer 51 at 57 is a thinner coating of such elastomer so as better to help bind the end of the protective cover to the web. At section 59 is shown an adhesive coating on the web onto which elastomer is placed and with which it is vulcanized or cured (but the adhesion agent does not always have to be curable).

Figure 5:
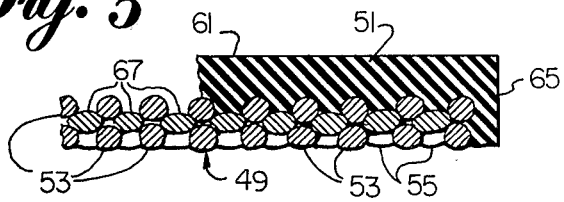
FIG. 5 is a partially cut away transverse vertical sectional view along plane 5—5 of FIG. 4.
Figure 6:
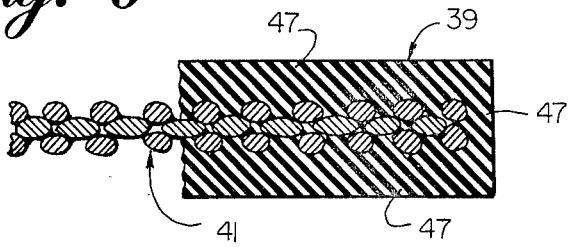
FIG. 6 is a partially cut away vertical sectional view taken substantially along plane 6—6 of FIG. 3.

In FIG. 5 elastomeric covering 51 is shown with a face 61 and sides 63 and 65 integral therewith covering web 49. Warp strands 53 are shown, as are straight longitudinal strands 67. The warp and woof strands are covered with elastomer at the face or major surface and the sides of the web and between the elastomer and the web is a thin coating of adhesive, not designated in this view because of its thinness, which coats the yarns and impregnates them down to the individual fibers. FIG. 6 shows a variation of the elastomer covered web of FIG. 5, wherein the elastomeric covering is on both major faces and the sides of the web so that the web is completely surrounded by an integral elastomeric covering. The sling 39 illustrated has elastomeric covering 47 surrounding synthetic organic polymeric web 41. The webs illustrated in FIGS. 4–6 may be employed as load or lift contacting portions of the slings of the types shown in FIGS. 1–3 but it is within the scope of this invention to cover all surfaces of such slings with such described elastomers.

The slings of this invention may be utilized in various manners to hoist cargo and other articles. For example, the highly versatile endless type sling illustrated in FIG. 1 can be used in a straight hitch, in a choker arrangement or as a basket sling. The twisted eye sling of FIG. 2 is especially adaptable for choker hitch use but may also be employed as a straight sling and as a basket sling, while the standard eye-and-eye is usually used in a basket or straight hitch configuration but may also be made into a choker hitch. The slings may be employed with hardware, usually metal fittings which are adapted to be held to sewn bights in the sling ends where the sling would otherwise contact a lifting hook or other lifting means. Normally the sling bights are sewn about the metal end fittings or the fittings may be bolted in place through a previously sewn end bight. The various types of slings and hardware for them are illustrated in Bulletin 705, entitled Buffalo Sling Guidebook and Price List, issued by Buffalo Weaving and Belting Company, 260 Chandler Street, Buffalo, New York 14207, in 1974.

Although various synthetic organic polymeric plastic materials may be employed for the manufacture of the web, including nylons, aramids, polyesters, poly-lower alkylenes (polyethylenes, polypropylenes and hybrids), acrylics, modacrylics, biconstituents and even acetates and rayons, the most preferred webs are those woven from nylon, aramid or polyester fibers or strands made from corresponding filaments. The nylons that may be used are crystalline, thermoplastic polyamide polymers having high tensile strengths, up to about 9 grams per denier, high melting points (223° C. for nylon 6 and 262° C. for nylon 66), low water absorption, good electrical resistance, high elasticity and low permanent elongation. The preferable nylon is nylon 66 but nylon 6 is also very useful and nylons 4, 9, 11, 12 and various others may also be employed. In general the nylons are attacked by strong mineral acids but are resistant to alkalis. Accordingly, nylon webs are normally employed where they will not be subjected to strong acids and where extension in use, due to their high elasticity, is unobjectionable. Aramids, such as those manufactured by E. I. Du Pont de Nemours & Co., Inc. under the trademark Kevlar, e.g., Kevlar 29 and Kevlar 49, are of higher strength and higher modulus in fiber form. Thus, such material is ideal for sling webs, which are strong, stretch resistant, of low density, non-melting at normal temperatures, flexible, fatigue resistant, thermally stable and dimensionally stable. The aramids are analogous to the nylons in chemical composition but, in accordance with Federal Trade Commission Rules and Regulations under the Textile Products Identification Act the aramids are those in which the fiber-forming substance is a long chain synthetic polyamide in which at least 85% of the amide linkages are attached directly to two aromatic rings while the nylons have less than 85% of the amide linkages therein so attached. The aramids are described in Modern Textiles, November, 1976 at pages 26–30. Polyester fibers and yarns, such as Dacron® and other brands of polyethylene terephthalate, other substituted aromatic carboxylic acid esters and para-substituted hydroxybenzoic acid esters, are also useful in the practice of the present invention. Polyethylene terephthalate, for example, is of excellent tensile strength, about 8 grams/denier. Such fibers elongate 10 to 36% before breaking and exhibit high elastic recovery. They are especially useful for employment in acid and alkaline environments and when the greater stretchings of nylons would be objectionable. The polyesters are described in Man-Made Fiber Fact Book, published in 1974 by the Man-Made Fiber Producers Association, Inc.

The filaments of the polymeric materials used may be of any suitable thicknesses, normally being at least 10 denier, about 0.1 micron, and rarely being in excess of 1 mm. in diameter, with preferred ranges of diameters being from 0.001 or 0.01 to 1 mm. Similarly, the number of filaments per single strand is in the range of about 10 to 1,000, normally being 20 to 500, and the strand thickness is from 0.1 mm to 1 cm., preferably 0.5 mm to 1 cm. and most preferably about 0.5 mm. to 5 mm.

The synthetic organic polymeric webs employed may be of various types but it is preferred that they be woven and of the woven webs it is preferred to utilize those having central or internal straight fiber sections to assist in better supporting the load, due to untwisted orientations thereof. Furthermore, by using a tell-tale of a different color fiber wear of the web in areas not covered by elastomer may be indicated. In general, ordinary belt weaves, such as are illustrated in the Buffalo Weaving and Belting Company guidebook, previously referred to, are preferred but simpler weaves may also be used. Of course, considering the type of weave, the size of the web, which may often be from 2 to 30 cm. wide, usually from 5 to 15 cm. wide and 0.2 to 2 cm. thick, preferably 0.3 to 1 cm. thick, will be sufficient to support the desired loads, often from 50 kg. to 50,000 kg., preferably 150 kg. to 5,000 kg. Sling lengths may be adjusted as desired but generally will be no shorter than 1.2 meters and usually are from 2 to 5 or 10 meters, although lengths to 50 meters or more are feasible. The covered web structures of the present invention are also usable in other applications than slings, for example, on arrestors for moving objects, such as aircraft, automobiles, boats, etc., in which use the elastomeric covering helps to prevent cutting through of the web by the arrested object. Among other applications are catapults, e.g., aircraft catapults, and sling sleeves or wear pads.

The lamina of elastomer which is vulcanized or cured onto a load contacting surface of the web of woven synthetic organic polymer strands may be of any suitable tough elastomeric material but the synthetic elastomers are preferred. Thus, while natural rubber and synthetics resembling it closely are useful in limited applicating chemically different synthetic elastomers or rubbers are preferred, such as polyurethanes and polychloroprene. Also useful in various cases are SBR, Buna-N, butyl and ethylenepropylene rubbers and the elastomers characterized as dimethylpolysiloxane; chloro-sulfonyl-polyethylene; acrylate-butadiene; hexafluoropropylene-vinylidene; polybutadiene; tetrafluoroethylenefluoronitrosomethane-perfluorobutyric acid; perchloromethyl oxirane; and ethylene oxide-chloromethyl oxirane. Even in those cases where the mentioned rubbers and elastomers are not useful alone to make the vulcanized or cured coverings of this invention on the webs of the types described often blends of these with other such rubbers and elastomers are operative, e.g., 90:10 to 10:90 blends or mixtures of three or more of the rubbers and elastomers. Of the polyurethanes the polyether type is preferred because it is more stable in aqueous media and moist atmospheres but often the polyester type may be successfully employed. For example, the basis for the elastomer may be poly-(oxy-1,4-butylene) ether or polyethylene adipate. The polyethers or polyesters of the polyurethane are obtainable by the reaction of a polyol or polyester with a diisocyanate, followed by curing, often with an amine or alcohol or other curing agent or vulcanizing agent. Among the useful commercial pre-polymers that may be employed to make the softer coverings of this invention may be mentioned Solithane 291 (Thiokol Chemical Co.); Formrez (Witco Chemical Co.); Cyanaprene (American Cyanamid Co.); Adiprene, e.g., Adiprene CM (E. I. Du Pont de Nemours & Co., Inc.); and Vibrathane (Uniroyal Corp.). Such pre-polymers may be made by reactions of polytetramethylene ether glycol with toluene diisocyanate or 1,4-butane diol, trimethylolpropane, triisopropanolamine or diethylene glycol may be used as the polyol and curing may be effected with a suitable amine or other vulcanization agent. Final curing is generally effected with heat alone, with the temperature usually being in the range of 90° to 180° C. over from 15 minutes to 6 hours, preferably followed by an aging period of from 1 to 10 days before use. The polyurethanes resulting desirably have a hardness of 30 to 90 Shore A, preferably 50 to 70 Shore A and most preferably about 60 Shore A. Other physical properties of the polyurethanes are described at page 566 of Modern Plastics Encyclopedia, 1971–1972, Vol 48, No. 10A (October, 1971), issued by Modern Plastics magazine. Additional descriptive material appears in the RMA Sheet Rubber Handbook on Gasket and Packing Materials, published September, 1962 by Rubber Manufacturers Association. Although it is possible to employ rubbers and elastomers of various types in practicing the present invention usually it will be preferable for the material used to have properties like the polychloroprenes and/or polyurethanes mentioned and often, for the numerically measurable properties, within ±20%.

The thickness of the elastomeric laminate on the surfaces of the web (on each face or side thereof) may be adjusted as desired for the particular application but will normally be within the range of 1 mm. to 2 cm., preferably 1 mm. to 1 cm. and more preferably 2 mm. to 7 mm. Such a thickness on the sides, as well as on the load contacting or load bearing (or lift contacting or lift bearing) face and even on the reverse face, is desirable so as to protect these surfaces of the web, too, although primary protection should be on the load contacting surface where abrasion and cutting are most likely to take place.

The various suitable elastomeric rubbers that may be employed may be thermoplastic or thermosetting and may be cured or vulcanized. In preferred embodiments of the invention polyurethane and polychloroprene are vulcanized or cured into place onto the woven web strands, utilizing an adhesive or suitable substance for promoting strong bonding of the elastomer to the web. Polyurethanes and polychloroprenes are preferred because of their strengths, elasticities and resistances to corrosive media.

The adherence-promoting material utilized, usually in a thin coating on the filaments of the web strands, is preferably a hydroxyaryl-aldehyde condensate of the novolak type, which is capable of undergoing additional curing when heated to form a more highly polymeric material. A preferred embodiment of such compounds is a resorcinol-formaldehyde material but xylol-formaldehyde, phenol-formaldehyde, phenol-acetaldehyde and various other hydroxy-, dihydroxy- and trihydroxy-benzene-lower (1,3 carbon atom) aldehyde products may also be employed. Generally, these are dissolved in a suitable solvent, e.g., benzene, ethanol, water, acetone, and are applied to the polymeric web (as by dipping of the web into the liquid), allowing the web to be coated thoroughly and throughout and actually allowing the individual filaments to be coated and to a certain extent impregnated by the curable adhesive or adhesion promoting material. The strands of the web are impregnated with such coating and normally the external thickness thereof on the web is from 0.001 mm. to 0.1 mm., although other thicknesses may also be suitable. Internal penetration into the strand filaments has not been measured but is generally considered to be about 1 to 50% of the external thickness. A most suitble preparation which has been employed successfully in manufacturing the present protected slings is that known as RFL, which is made for use in aiding the holding of rubbers onto substrates.

The elastomer-protected slings of the present invention are made by weaving a web of desired size from filaments, fibers or strands of polymeric material in the usual way known in the sling manufacturing art, preferably with straight line, longitudinal fibers between the warp and woof of the web; coating or impregnating it with the desired amount of a solution of adhesion-promoting compound, usually in a solution which is of 10 to 50% solids content; evaporating off the solvent, if any; placing atop the surface to be covered a layer, lamina or sheet of rubber or rubber-like elastomer to be cured (including the usual vulcanizing or curing agent calendered into the sheet, but the rubber or elastomer mix may be made by other mixing or extruding technique or may be applied to the textile web by dipping or spraying too, although these are methods which are much less preferred [dipping is only within the invention if utilized with similar application of adhesion-promoting agent]); and vulcanizing or curing the elastomer and adhesion-promoting agent. The adhesion promoter-coated web, with elastomer in place, is next subjected to pressure, primarily exerted on the major faces thereof, together with heat to vulcanize or cure the elastomer and agent onto the web. The temperatures and pressures employed may be varied, depending on the particular vulcanizing or curing agents used and the percentages thereof present, which usually may be from about 0.01 to 5%. Curing temperatures will normally be in the range of 50° to 200° C., preferably 80° to 170° C. and pressures will be from 3 kg./sq. cm. to 500 kg./sq. cm., preferbly from 10 to 100 kg./sq. cm. During the curing, which may take place in a suitable press or pressure mold, e.g., a platen press, the web may be held under tension, e.g., 1 to 1,000 kg./sq. cm., preferably 3 to 100 kg./sq. cm., to maintain the textile web in desired tight configuration during application of the protective elastomeric cover to it, to prevent shrinkage thereof during the application of the elastomer and/or to stretch the polymeric strands during the vulcanization or cure to reduce end-use elongation (since the elastomer will resist returning the stretched textile to relaxed position). By such method the normal stretching of a nylon web material may be reduced by as much as 25 to 90%, especially for initial loadings thereof and even polyester (Dacron) stretching can be lowered. If the stretching is reduced then the abrading or cutting effects of sharp edges of the load on the elastomer or other sections of the sling will also be lessened (since stretching causes relative web motion with respect to the load), which is highly desirable to prolong sling life.

In the usual manufacturing methods a web, either with the holding loops already sewn in or before such sewing or binding, is treated with adherence promoting agent and is then covered on the face which will be contacting or bearing the designed load with a layer of elastomer which is vulcanized or cured in place, preferably with the simultaneous curing of the adherence promoting agent so as to form a better bond to the polymeric fibrous substrate. The curing of the rubber or elastomer under pressure forces the elastomer to fill various openings between fibers of the substrate and thereby helps it better to hold onto these and to maintain them in position. However, the rubber does not normally penetrate through the web (usually only passing 10 to 50% of the distance through it) and thereby still allows a desired amount of sliding movement of the filaments as they stretch due to the application of load or contract when the load is removed. However, in some instances, as when greater rigidity of the web is desired, the rubber may penetrate the web to an extent greater than 50%, even completely. The elastomer, in addition to protecting the web, helps to hold the strands thereof in desired orientation and helps to prevent disproportionate loadings of some parts of the web. The elastomer may be applied in a similar manner to the lift mechanism- or hardware-contacting part of the sling, which is usually the inner part of the loop or bight at the end of the sling, and such application may be before or after the bight is formed and sewn or otherwise fastened in place. If desired, a platen press or other means for vulcanizing the elastomer onto the web may be modified so as to allow applications of elastomer after sewing of the end and/or lift loops or bights. Normally, however, the bights will be made after applications of the elastomer to the desired location. In some modifications of the manufacturing process the web may be treated with adhesion agent at a number of locations thereon, e.g., the load contacting and lift contacting sections (before sewing of the lift loops), and then the elastomer may be applied to such sections either simultaneously, as is preferred, using a press equipped to press both sections at one time, or sequentially. During pressing operations some of the elastomer may be integrally applied in a thin film or coating (e.g., 0.1 to 5% of its protective thickness and about 1 to 10% of its length) to an area of the web adjacent to that where its protective thickness is applied, thus helping to prevent any possibility of easy peel-back of the protective covering of elastomer when an end thereof is acted on by a shearing force.

The present slings and methods for their manufacture are significant improvements over previous slings, some of which may have been coated over portions of their lengths with very thin rubber or elastomeric coatings, e.g., polyurethane deposited from a solution, although in most cases plain slings were employed. Of course, as was previously mentioned, the protective thickness of elastomer is important to prevent cutting, gouging and abrasion of the web and the subjection of it to contacts with potentially harmful liquid and gaseous media and such protection was not obtained when the solution deposits of thin coatings of elastomers were effected. Coverings of the sides of the webs together with the load or lift contacting surface is important because the rubber is thereby held better to the textile web and the sides are also protected against accidental contacts with sharp or abrading objects. This good holding to the web is very important because nylons, aramids and polyesters, being extremely smooth, may often be difficult to bond to coating materials. Also, the rubber or elastomer lamina penetrates surface openings between the strands for better holding but needs not interfere with the other smooth surface-to-surface contacts between the strands. The adhesion agent, normally being curable with the rubber at the same time that it is cured or vulcanized, bonds well to both the rubber and the textile web with which it was previously impregnated. It provides a coating which additionally protects the web against corrosive atmospheres and liquid media and at the same time tends to stiffen the strands somewhat so as to make them less yielding upon the application of a load. When the strands are maintained under tension during curing of the elastomer thereon such stretchability of the load contacting portion is further diminished. Similarly, the presence of the thin coating of adhesion agent helps to diminish possible moisture absorption by the filaments on unprotected parts thereof, which absorption could otherwise cut the load carrying capacity of the sling by more than 10%. These various advantages often add up to a significant improvement, in sling operating characteristics and an increase in sling life of even more than 100%, for example, from six months to two years or more, when the sling is employed in hoisting sharp edged metal cargoes or packing cases.

The following examples illustrate the invention but do not limit it. Unless otherwise mentioned all temperatures are in °C. and all parts are by weight.

EXAMPLE 1

An endless strap sling of the type illustrated in FIG. 1 and of the structure shown in FIGS. 4 and 5 is made from 1,100 denier polyethylene terephthalate (Dacron) strands or plies (with the individual fibers thereof being of about 10 to 50 denier), twisted together to form 8-ply yarns and woven in known manner to a 10 cm. width and 6 mm. thickness. The web made, easily capable of supporting a five metric ton load in single thickness when new, is next dipped into an RFL solution or dispersion (RFL stands for resorcinol-formaldehyde-latex) of the following composition:

| | Parts |
|---|---|
| Resorcinol | 16.8 |
| Formaldehyde (37% aqueous solution) | 14.7 |
| NaOH (50% aqueous solution) | 2.6 |
| Water (Buffalo, New York tap) | 331.1 |
| Gen-Tac latex, (vinyl-pyridine latex, 41% soilds, General Tire and Rubber Company) | 195.0 |
| Pliolite Latex No. 2108 (styrene-butadiene rubber latex, 40% solids, Goodyear Tire and Rubber Company, Chemical Division | 50.0 |

The RFL solution is produced by mixing together at room temperature the resorcinol, formaldehyde solution, sodium hydroxide and water to produce the resorcinol-formaldehyde component, separately mixing the Gen-Tac latex and the Pliolite Latex No. 2108, also at room temperature, to produce a latex mix and mixing the two pre-mixes together at room temperature. After mixing is completed the RFL product is aged 24 hours before use and is normally employed thereafter to precoat the polyester web within a period of seven days after manufacture, preferably within one or two days. During storage before use it is maintained at about room temperature, protected from heat and freezing.

After dipping the web into the RFL solution it is air dried and the add-on (dry) is 12% of the web weight. The dipping is such that the area of application of the RFL extends over the surface of the web to which protective curable elastomer is to be applied plus an area beyond that on each side of the protective elastomer area, extending on each side for about 20% of the length of the protective elastomer section. The RFL penetrates through the web and coats the fibers, plies (strands) and yarns and even impregnates the individual fibers or filaments to an extent in the range of 1 to 50% of the thickness thereof. The RFL solids may add about a 0.01 mm. thickness onto the surface of the exterior fibers or the strands.

After drying of the web containing the RFL a sheet of vulcanizable polyurethane (Adiprene CM, with a regular sulfur system for vulcanization, made by E. I. Du Pont de Nemours & Company, Inc.) of a width of 11 cm. and a thickness of 5 mm. is plced on the web and the web, which is of sufficient length to produce a one-piece sling, with the polyurethane strip in desired protective position, is placed in a heated platen press, which is so shaped as to allow the polyurethane to flow and cure in position on the sides of the web as well as on the one major surface thereof to be protected, and a pressure of 20 kg./sq. cm. gauge is applied at a temperature of 160° C. for twenty minutes. The mold is then cooled and the woven web with the protective covering of cured or vulcanized polyurethane elastomer on the major surface and the sides thereof about three mm. thick and filling the openings between the yarns at the major surface and the sides and extending about 10% of the distance through the web, is removed.

The web is then cut to desired length and the ends thereof are sewn together or otherwise satisfactorily fastened together to form an endless strap or flat sling with the vulcanized elastomeric protective covering on the load contacting portion thereof and the corresponding sides. Such a sling, when used to hoist sharp edged heavy metal objects, has a useful life significantly longer than that of an unprotected sling of the same type, ofen about twice the useful life. Furthermore, when the protective surface has been cut or scraped so that it is no longer considered to be sufficiently impervious to protect the web beneath it is treated with the RFL or similar adhesion promoting agent and another strip of curable polyurethane is applied and cured in place, thereby renewing the covering and making the sling ready for use again. In some cases, as when the sling protective covering portion has been badly worn, it may be removed and a completely new covering may be applied. Such treatments extend the lives of such slings to as long as five years, compared to control sling lives which are often less than a year in severe applications.

Instead of using a polyurethane prepolymer and curing it to the polymeric web material a polychloroprene (neoprene) that is in the same size strip form is employed and the cure is effected the same way except that the temperature is maintained at 157° C. for 30 minutes. The product made is of a hardness comparable to the 60 Shore A of the polyurethane covering made and the protected sling has a useful life of about 18 months, compared to about nine months for an unprotected sling.

In variations of the manufacturing procedure other webs are treated and covered with protective elastomer, with the webbing being of nylon 66, nylon 6 (both of 840 denier per ply), aramid fiber (Kevlar, Kevlar 29, Kevlar 49), polyethylene, acrylics, modacrylics, acetates, rayons, cottons and steels and mixtures or blends thereof, e.g., polyester-cotton, the webs are from 5 to 15 cm. in width and 0.3 to 1 cm. in thickness and the slings are made of lengths (before fastening the ends together) of two to five meters. Instead of employing vulcanizable or curable polyurethane or polychloroprene sheets or strips, natural rubber, SBR, Buna-N, butyl and ethylene-propylene rubbers are substituted and in some applications the rubbers are applied in powder or crumb form. Curing temperatures are varied satisfactorily over the range of 80° to 170° C., pressures are applied from 10 to 100 kg./sq. cm. and curing times are varied from five minutes to two hours, usually depending at least in part on the thickness of the elastomeric covering, such thickness being varied from two to seven mm. The slings made using the aramid, nylon and polyester fibers and strands are considered to be superior in overall properties (strength, resilience, resistance or corrosives, to name a few) to those of the other materials and the polyurethane and polychloroprene coverings are considered to be better than the others mentioned, with the synthetic polymeric elastomeric or rubber materials being better than the natural product, on the whole.

In a further modification of the above procedures slings of the endless strap type are made with additional sections of elastomer covering thereon at a surface opposite that of the described covering (or opposite to it after the web has been sewn into an endless strap) where a hook or lifting element is normally applied to the sling during use. It is noted that the presence of such protective covering additionally helps to prevent wear of the sling at such a lifting strain point and extends its useful life in those cases where lifting hooks, rather than the preferred special fittings, are employed to apply lifting forces to the slings.

When the described procedure is followed except for the omission of pre-treatment of the web before application of the elastomeric covering the covering does not hold as satisfactorily to the web and sometimes tends to peel off during use. When the resorcinol-formaldehyde portion of the RFL composition is applied alone (with the sodium hydroxide and water but without the latices) the bond made, while satisfactory for many purposes, is not as good as that obtained when the latices are also present. Similarly, use of either the vinyl-pyridine latex or the styrene-butadiene latex with the components of the pre-treatments but without the other latex results in a bond of the polyurethane, polychloroprene or other elastomer covering material that is not as strong and not as satisfactory as that described in the above example. As substitutes for the resorcinol-formaldehyde there may be used xylol-formaldehyde, phenol-formaldehyde, phenol-acetaldehyde and other hydroxybenzene-lower aliphatic aldehyde condensates, and other solvents may be employed too, e.g., ethanol. Other suitable elastomer latices may also be used satisfactorily, such as natural rubber and polychloroprene latices, and applications may be by roller coating or spraying instead of dipping or immersion.

In another preferred embodiment of the invention, illustrated in FIG. 4, a thin layer of elastomeric coating extends beyond the ends of the major thickness of such covering. This helps to seal the main section of elastomeric covering in place better and to prevent accidental removing of it or curling up of the edges due to lateral or sliding contacts with loads on the sling. Thus, because of the presence of the described extension of elastomeric covering, which may be about 1 to 50% of the protective thickness and about 1 to 30% of the length thereof (the protective covering length usually being in the range of about 20 cm. to 1.5 m.), the main protective covering is held more tightly to the web and curlings of the ends during use are prevented or lessened. Instead of using a thin flat extension of the elastomeric covering it is often desirable to have it tapered, extending from the full thickness of the covering to a minimal thickness, thereby removing any side portion of the covering against which a moving load might bear to work loose the covering. The mentioned extensions of the covering are normally applied with the covering proper and are cured with it, preferably by having the mold shaped accordingly, but they may be applied separately too, as by brushing on and heat curing while molding the cover portion. Desirably, they also extend along the sides of the web. In the usual embodiments of the invention the protective covering is preferably flat, as is the extension thereof but it is within the invention to mold these so appear they appeadr ribbed, cross-hatched, striated or otherwise, too.

The protective covering may sometimes be held better to the web by utilizing a less tightly woven web, with more openings in it, e.g., 1 to 10% free passage through the web, rather than the present 0%, and/or with the curing pressures and temperatures being at the high ends of the ranges previously given, whereby the elastomer can more readily penetrate the web. However, while such structure may be desirable in some instances, in other cases it can interfere with load bearing capabilities of the web fibers and therefore such penetration through the web is often avoided (the application of the hydroxybenzene-lower aldehyde-latex prepolymer adhesive also helps to limit such penetration).

EXAMPLE 2

To make the described sling of Example 1 reversible and to have the protective elastomeric covering even more satisfactorily held to the web the procedures of Example 1 are modified so as to have two sheets or strips of elastomer (or the equivalent of two sheets) employed and the mold is adapted to produce the type of covered web illustrated in FIGS. 3 and 6. However, despite the advantages a sling of such type possesses it is more expensive and often is unnecessary, since the protective portion of the sling may well outwear other parts of it.

EXAMPLE 3

Slings of the type illustrated in FIG. 2 are made according to the procedures of Example 1. In a modification of that procedure the eyes of the slings also have protective coverings applied to the webs thereof before they are formed. Such procedure is also followed in making the covered eyes of slings of the type illustrated in FIG. 3. Normally the protective coverings are applied only to the insides of the eyes but they may also be applied to the reverse sides.

EXAMPLE 4

The slings previously described are first made without the elastomeric protective coverings thereon and after manufacture of the slings such coverings are cured into place, as previously described. The applications of the coverings and pre-covering materials are by the methods previously mentioned with the exception that the curing molds are modified so as to be able to apply the elastomeric coverings to the eye interiors.

EXAMPLE 5

The procedures of the foregoing examples are repeated but with tensions being placed on the webs longitudinally (and optionally, laterally, too) during the curings of the protective coverings thereon. Tensions applied are 3, 50 and 100 kg./sq. cm. and such applications are to webs of polyester, aramid and nylons of the types previously mentioned in these examples and the previous description. Upon completion of the molding and curng the tension is released. Yet, because of the binding effect of the protective elastomeric covering on the web the web is at least partially maintained in tension and the elastomeric covering is at least partially maintained in compression. This limits the initial stretching of the web, which is of greatest importance in the case of the nylon web, when it is subjected to a load, and thereby helps to prevent movements of the web surfaces with respect to the load, thereby diminishing wearing of the sling. In the case of nylons initial stretchings may be reduced by as much as 50 to 90%. The compressive forces on the elastomer, maintained by the tension of the web material, are also useful, tending to prevent any cut-prone materials from having such initial cuts open up to the extent that could otherwise result.

In this and the other examples the elastomeric nature of the covering is maintained by utilizing the normal proportions of curing agents in the rubber sheets or strips, such as 1 to 5%, for example, 2% of sulfur, but the elasticity may be increased or diminished by varying the proportions thereof. However, it will normally be held to 50 to 1,000%. Usual other ingredients of rubber compositions may also be present in the strip to be vulcanized to the web, such as accelerators, loading or filling agents, softeners, extenders, colorants, antioxidants, antiozonants, odorants, etc. Normally the amounts of such materials will be in the range of 0.1 to 5% and the total content thereof will be no more than 50% of the final rubber or elastomer, preferably less than 10% thereof. As examples of specific materials of such types that may be employed in the various useful rubbers and elastomers there may be mentioned zinc oxide, stearic acid, mercaptobenzothiazole, phenols and bisphenols.

The invention has been described with respect to illustrations and examples thereof but is not to be limited to these because it is evident that one of skill in the art can utilize substitutes and equivalents without departing from it.

What is claimed is:

1. A sling which comprises a web of woven synthetic organic polymeric strands of filaments of material selected from the group consisting of nylon, aramid and polyester, with a lamina of a synthetic elastomeric polyurethane vulcanized or cured onto a load contacting surface thereof and filling surface openings between the polymeric strands, and with a thin coating on the strands and filaments thereof, between the synthetic organic polymer of the strands and filaments and the polyurethane, of a material which aids adhesion of the polyurethane to the strands.

2. A sling according to claim 1 wherein the synthetic organic polymeric plastic filaments are of nylon 66, nylon 6, aramid or polyethylene terephthalate.

3. A sling according to claim 2 wherein the thin coating is of a resorcinol-formaldehyde adhesive.

4. A sling according to claim 1 wherein the adhesive material impregnates the strands.

5. A sling according to claim 3 wherein the resorcinol-formaldehyde adhesive impregnates the strands and coats the filaments thereof.

6. A sling according to claim 5 wherein the filaments are of a diameter in the range of 0.01 mm. to 1 mm., the number of filaments per strand is in the range of 20 to 500, the strand thickness is from 0.5 mm. to 1 cm., the resorcinol-formaldehyde adhesive is an RFL adhesive, the thickness thereof on the web is from 0.001 mm. to 0.1 mm., the thickness of the polyurethane laminate on a surface of the web is from 1 mm. to 1 cm. and the web is from 0.2 to 2 cm. thick.

7. A sling according to claim 6 wherein the polyurethane laminate covers a load contacting face area of the web and adjacent sides thereof.

8. A sling according to claim 7 wherein the polyurethane laminate also covers the corresponding reverse face area of the web, integrally with the load contacting surface and sides thereof and is integrally vulcanized therewith.

9. A sling according to claim 6 wherein a thin covering of cured polyurethane is present on the load bearing surface of the web at the ends of and contiguous with the protective lamina of polyurethane, which covering is from 0.1 to 100% of the thickness of the protective polyurethane lamina and extends from 1 to 30% of the length of said protective lamina.

10. A sling according to claim 1 wherein, in addition to the load contacting surface being laminated with elastomeric material, a lift contacting surface is also so laminated.

11. A sling according to claim 1 wherein the elastomeric material does not penetrate the thickness of the web.

12. A sling according to claim 7 wherein the polyurethane laminate also covers a lift contacting surface of the web and edges thereof.

13. A sling according to claim 7 wherein the synthetic organic polymeric filaments are of nylon 66.

14. A sling according to claim 7 wherein the synthetic organic polymeric filaments are of nylon 6.

15. A sling according to claim 7 wherein the synthetic organic polymeric filaments are of aramid.

16. A sling according to claim 7 wherein the synthetic organic polymeric filaments are of polyethylene terephthalate.

17. A method of making a sling which comprises simultaneously vulcanizing or curing a laminating polyurethane elastomer onto portions of a surface of a web of woven synthetic organic polymeric strands, wherein the polymer is selected from the group consisting of nylons, aramids and polyesters, which portions of the web surface are to be load contacting and/or lift contacting when the web is made into a sling and which portions have on surfaces of the strands and filaments thereof a thin coating of a material which aids adhesion of the polyurethane to the strands, so that the polyurethane fills surface openings between the polymeric strands, and fastening portions of the web together so as to form a sling.

18. A method of making a sling which comprises impregnating a web of woven synthetic organic polymeric plastic strands, wherein the polymer is selected from the group consisting of nylons, aramids and polyesters, with material which aids adhesion to the strands of a subsequently to be applied laminating elastomeric coating of polyurethane and curing or vulcanizing onto the web where the adhesive has been applied a layer of such polyurethane so that it penetrates surface openings between the polymeric strands.

19. A method according to claim 18 wherein the adhesive material is a resorcinol-formaldehyde polymer solution which is curable during the curing or vulcanizing of the polyurethane and which is applied as a liquid.

20. A method according to claim 19 wherein the synthetic organic polymer is a nylon 66, nylon 6, aramid or polyethylene terephthalate, the polyurethane is in unvulcanized sheet form when applied to the adhesive-impregnated web, the area of such application is that which is to be load contacting when the web is made into a sling and the web and sheet or layer of unvulcanized and vulcanizable polyurethane are heated and maintained under pressure until the polyurethane is vulcanized to the web and covers the load contacting area thereof and contiguous sides.

21. A method according to claim 20 wherein a layer of vulcanizable polyurethane is applied to the web on the surface opposite that to be load contacting and both layers of polyurethane are vulcanized to the web under heat and pressure so as to coat it with integrally vulcanized polyurethane surfaces and sides.

22. A method according to claim 20 wherein the filaments of the web are of a diameter in the range of 0.01 mm. to 1 mm., the number of filaments per strand is in the range of 20 to 500, the strand thickness is from 0.5 mm. to 1 cm., the resorcinol-formaldehyde adhesive is an RFL adhesive, the thickness of the RFL adhesive on the web is from 0.001 mm. to 0.1 mm., the thickness of the polyurethane on the surface of the web is from 1 mm. to 1 cm. and the web is from 0.2 to 2 cm. thick.

23. A method according to claim 22 wherein a lift contacting surface of the web or a plurality of such surfaces is/are also coated with the same adhesive and vulcanizable polyurethane and are vulcanized to the web by the same process.

24. A method according to claim 17 wherein the elastomer does not penetrate the thickness of the web.

25. A method according to claim 18 wherein the web is maintained under a stretching tension during the curing or vulcanization of the laminating polyurethane coating to it.

26. A method according to claim 18 wherein after curing or vulcanization of the polyurethane coating onto the web portions of the web are fastened together so as to form a sling.

27. A method according to claim 18 wherein portions of the web are fastened together so as to form a sling before curing or vulcanization of the polyurethane onto the web.

* * * * *